US008391743B2

(12) United States Patent
Yamaguchi et al.

(10) Patent No.: US 8,391,743 B2
(45) Date of Patent: Mar. 5, 2013

(54) FIXING DEVICE AND IMAGE FORMING APPARATUS INCORPORATING SAME

(75) Inventors: Yoshiki Yamaguchi, Sagamihara (JP); Masanao Ehara, Zama (JP); Naoki Iwaya, Chofu (JP); Yutaka Ikebuchi, Chigasaki (JP)

(73) Assignee: Ricoh Company, Ltd., Tokyo (JP)

( * ) Notice: Subject to any disclaimer, the term of this patent is extended or adjusted under 35 U.S.C. 154(b) by 373 days.

(21) Appl. No.: 12/876,589

(22) Filed: Sep. 7, 2010

(65) Prior Publication Data

US 2011/0064451 A1 Mar. 17, 2011

(30) Foreign Application Priority Data

Sep. 15, 2009 (JP) ..... 2009-213305

(51) Int. Cl.
*G03G 21/00* (2006.01)

(52) U.S. Cl. ..... 399/99

(58) Field of Classification Search ..... 399/99, 399/322, 400

See application file for complete search history.

(56) References Cited

U.S. PATENT DOCUMENTS

| | | | | |
|---|---|---|---|---|
| 5,832,354 | A | 11/1998 | Kouno et al. | |
| 5,915,147 | A | 6/1999 | Kouno et al. | |
| 6,219,520 | B1 | 4/2001 | Ehara | |
| 6,628,916 | B2 | 9/2003 | Yasui et al. | |
| 6,636,709 | B2 | 10/2003 | Furukawa et al. | |
| 6,661,989 | B2 * | 12/2003 | Pitts et al. | 399/322 |
| 6,778,790 | B2 | 8/2004 | Yoshinaga et al. | |
| 6,785,505 | B2 | 8/2004 | Yasui et al. | |
| 6,807,386 | B2 | 10/2004 | Yasui et al. | |
| 6,881,927 | B2 | 4/2005 | Yoshinaga et al. | |
| 6,882,820 | B2 | 4/2005 | Shinshi et al. | |
| 6,892,044 | B2 | 5/2005 | Yasui et al. | |
| 7,022,944 | B2 | 4/2006 | Yoshinaga et al. | |
| 7,127,204 | B2 | 10/2006 | Satoh et al. | |
| 7,239,838 | B2 | 7/2007 | Satoh et al. | |
| 7,242,897 | B2 | 7/2007 | Satoh et al. | |
| 7,313,353 | B2 | 12/2007 | Satoh et al. | |
| 7,437,111 | B2 | 10/2008 | Yamada et al. | |

(Continued)

FOREIGN PATENT DOCUMENTS

| | | |
|---|---|---|
| JP | 11-202655 | 7/1999 |
| JP | 2001-097604 | 4/2001 |

(Continued)

OTHER PUBLICATIONS

U.S. Appl. No. 12/780,309, filed May 14, 2010, Hasegawa, et al.

(Continued)

*Primary Examiner* — Walter L Lindsay, Jr.
*Assistant Examiner* — Billy J Lactaoen
(74) *Attorney, Agent, or Firm* — Oblon, Spivak, McClelland, Maier & Neustadt, L.L.P.

(57) ABSTRACT

A fixing device to fix a toner image on a sheet of recording media, the fixing device includes a fixing rotary member to heat the toner image on the sheet of the recording media, a pressure rotary member pressed against the fixing rotary member, a conveyance guide member arranged to a fixing nip at the upstream side of a conveyance direction of the sheet to support the sheet going to the fixing nip, a scraper arranged to the conveyance guide member at the opposite side on the basis of the conveyance direction. The end of the conveyance guide member contacts with the scraper, when the conveyance guide member turns on a rotary axis of the guide member.

17 Claims, 8 Drawing Sheets

U.S. PATENT DOCUMENTS

| | | | |
|---|---|---|---|
| 7,454,151 | B2 | 11/2008 | Satoh et al. |
| 7,466,949 | B2 | 12/2008 | Satoh et al. |
| 7,509,085 | B2 | 3/2009 | Yoshinaga |
| 7,546,049 | B2 | 6/2009 | Ehara |
| 7,702,271 | B2 | 4/2010 | Yamada et al. |
| 2006/0257183 | A1 | 11/2006 | Ehara et al. |
| 2008/0063443 | A1 | 3/2008 | Yoshinaga |
| 2008/0317532 | A1 | 12/2008 | Ehara et al. |
| 2009/0123201 | A1 | 5/2009 | Ehara et al. |
| 2009/0148204 | A1 | 6/2009 | Yoshinaga et al. |
| 2010/0074667 | A1 | 3/2010 | Ehara et al. |

FOREIGN PATENT DOCUMENTS

| | | |
|---|---|---|
| JP | 2005-164712 | 6/2005 |
| JP | 2008-122719 | 5/2008 |
| JP | 2008-170787 | 7/2008 |

OTHER PUBLICATIONS

U.S. Appl. No. 12/841,593, filed Jul. 22, 2010, Yoshikawa, et al.

* cited by examiner

FIXING DEVICE AND IMAGE FORMING APPARATUS INCORPORATING SAME

CROSS-REFERENCE TO RELATED APPLICATIONS

The present patent application claims priority pursuant to 35 U.S.C. §119 from Japanese Patent Application No. 2009-213305, filed on Sep. 15, 2009 which is hereby incorporated by reference herein in its entirety.

BACKGROUND OF THE INVENTION

1. Field of the Invention

Exemplary aspects of the present invention relate to a fixing device and an image forming apparatus incorporating the same, and more particularly, to a fixing device that fixes a toner image in place on a recording medium with heat and pressure, and an electrophotographic image forming apparatus incorporating such a fixing device.

2. Discussion of the Background

Electrophotographic image forming apparatuses, such as copiers, facsimile machines, printers, or multifunction printers having at least one of copying, printing, scanning, and facsimile functions, typically form an image on a recording medium according to image data. Thus, for example, a charger uniformly charges the surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such a fixing device may include a fixing roller and a pressing roller pressing against each other to form a fixing nip therebetween. As a recording medium bearing a toner image passes through the fixing nip, the fixing roller applies heat to the recording medium to melt the toner image and fix it on the recording medium.

The image forming apparatus may include a conveyance guide board which supports the recording medium just before the recording medium goes into the fixing nip. The conveyance guide board is provided just before the fixing nip, such that the recording medium goes into the fixing nip while contacting the conveyance guide board.

SUMMARY OF THE INVENTION

In view of the foregoing, one illustrative embodiment provides a fixing device to fix a toner image on a sheet of recording media. The fixing device includes a fixing rotary member, a pressure rotary member, a conveyance guide member, a scraper, a driving mechanism. The fixing rotary member heats the toner image on the sheet. The pressure rotary member is disposed in contact with the fixing rotary member and forms a fixing nip through which the sheet passes. The conveyance guide member is arranged to the fixing nip at the upstream side of a conveyance direction of the sheet. The conveyance guide member has a guide surface which supports the sheet going to the fixing nip, an end of the guide surface, which faces the fixing nip, and a rotary axis arranged in parallel to an axial direction of the pressure rotary member. The driving mechanism has a motor which rotates the conveyance guide member. The scraper is arranged to the conveyance guide member at the opposite side on the basis of the conveyance direction of the sheet. The scraper has a scrapable surface in contact with the end of the guide surface, when the conveyance guide member rotates around the rotary axis of the guide member.

Another illustrative embodiment provides an image forming apparatus that includes an image carrier, a charging device to charge the image carrier uniformly, an exposure device to expose the charged surface of the image carrier, forming a latent image on the image carrier, a developing device to visualize the latent image formed on the surface of the image carrier, a transfer device to transfer the visualized image onto a recording medium directly or indirectly via an intermediate transfer member, and the fixing device described above to fix the image on a sheet of recording medium.

BRIEF DESCRIPTION OF THE DRAWINGS

Amore complete appreciation of the disclosure and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
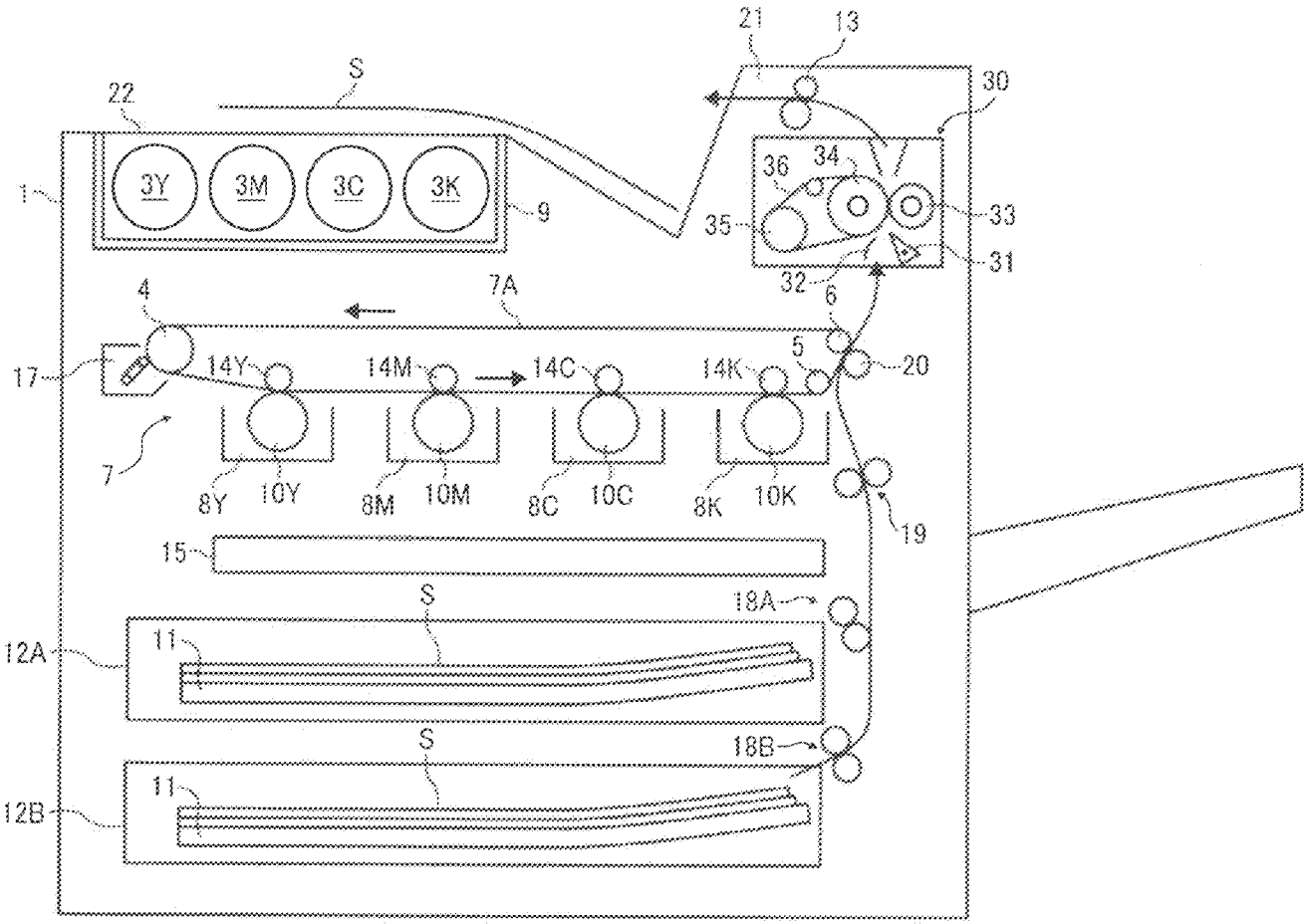
FIG. 1 is an overall schematic view illustrating a configuration of an image forming apparatus including a fixing device according to one illustrative embodiment of the present invention.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an example of an image forming apparatus 1 incorporating a fixing device 30 according to this patent specification.

As shown in FIG. 1, the image forming apparatus 1 is a tandem color printer including four imaging stations 8Y, 8M, 8C, and 8K arranged in series along the length of an intermediate transfer unit 7 and adjacent to a write scanner 15, which together form an electrophotographic mechanism to form an image with toner particles on a recording medium such as a sheet of paper S. The image forming apparatus 1 also includes a first feed roller 18A, a second feed roller 18B, a pair of registration rollers 19, and a pair of ejection rollers 13 together defining a sheet feed path, indicated by arrows in the drawing, along which a recording sheet S advances toward an output tray 22 atop the apparatus 1 from sheet feed trays 12A and 12B accommodating a stack of recording sheets at the bottom of the apparatus 1 through the fixing device 30 according to this patent specification.

In the image forming apparatus 1, each imaging unit (indicated collectively by the reference numeral 8) has a drum-shaped photoconductor 10 surrounded by a charging device, a development device, a cleaning device, a discharging device, not shown, etc., which work in cooperation to form a toner image of a particular primary color, as designated by the suffix letters, "Y" for yellow, "M" for magenta, "C" for cyan, and "K" for black. The imaging units 8Y, 8M, 8C, and 8K are supplied with toner from replaceable toner bottles 3Y, 3M, 3C, and 3K, respectively, accommodated in a toner supply 9 in the upper portion of the apparatus 1.

The intermediate transfer unit 7 includes an intermediate transfer belt 7A, four primary transfer rollers 14Y, 14M, 14C, and 14K, and a belt cleaner 17, as well as a transfer backup roller or drive roller 6, a cleaning backup roller 4, and a tension roller 5 around which the intermediate transfer belt 7A is entrained. When driven by the roller 6, the intermediate transfer belt 7A travels counterclockwise in the drawing along an endless travel path, passing through four primary transfer nips defined between the primary transfer rollers 14 and the corresponding photoconductive drums 10, as well as a secondary transfer nip defined between the transfer backup roller 6 and a secondary transfer roller 20.

The fixing device 30 includes a pair of first and second rotary members 33 and 34, one being heated and the other being pressed against the heated one, to form a fixing nip N therebetween in the sheet feed path. Detailed description of several embodiments of the fixing device 30 according to this patent specification will be given with reference to FIG. 2 and subsequent drawings.

During operation, each imaging unit 8 rotates the photoconductor drum 10 clockwise in the drawing to forward its outer, photoconductive surface to a series of electrophotographic processes, including charging, exposure, development, transfer, and cleaning, in one rotation of the photoconductor drum 10.

First, the photoconductive surface is uniformly charged by the charging device and subsequently exposed to a modulated laser beam emitted from the write scanner 15. The laser exposure selectively dissipates the charge on the photoconductive surface to form an electrostatic latent image thereon according to image data representing a particular primary color. Then, the latent image enters the development device which renders the incoming image into visible form using toner. The toner image thus obtained is forwarded to the primary transfer nip between the intermediate transfer belt 7A and the primary transfer roller 14.

At the primary transfer nip, the primary transfer roller 14 applies a bias voltage of a polarity opposite that of toner to the intermediate transfer belt 7A. This electrostatically transfers the toner image from the photoconductive surface to an outer surface of the belt 7A, with a certain small amount of residual toner particles left on the photoconductive surface. Such transfer process occurs sequentially at the four transfer nips along the belt travel path, so that toner images of different colors are superimposed one atop another to form a multicolor image on the surface of the intermediate transfer belt 7A.

After primary transfer, the photoconductive surface enters the cleaning device to remove residual toner by scraping off with a cleaning blade, and then to the discharging device to remove residual charges for completion of one imaging cycle. At the same time, the intermediate transfer belt 7A forwards the multicolor image to the secondary transfer nip between the transfer backup roller 6 and the secondary transfer roller 20.

In the sheet feed path, the feed roller 18A rotates counterclockwise in the drawing to introduce a recording sheet S from the sheet tray 12A toward the pair of registration rollers 19. The registration rollers 19 hold the fed sheet S, and then advance it in sync with the movement of the intermediate transfer belt 7A to the secondary transfer nip. At the secondary transfer nip, the multicolor image is transferred from the belt 7A to the incoming sheet S, with a certain small amount of residual toner particles left on the belt surface.

After secondary transfer, the intermediate transfer belt 7A enters the belt cleaner 17, which removes and collects residual toner from the intermediate transfer belt 7A. At the same time, the recording sheet S bearing the powder toner image thereon is introduced into the fixing device 30, which fixes the multicolor image in place on the recording sheet S with heat and pressure through the fixing nip N.

Thereafter, the recording sheet S is ejected by the output rollers 13 to the output tray 22 to complete one operational cycle of the image forming apparatus 1.

Figure 2:
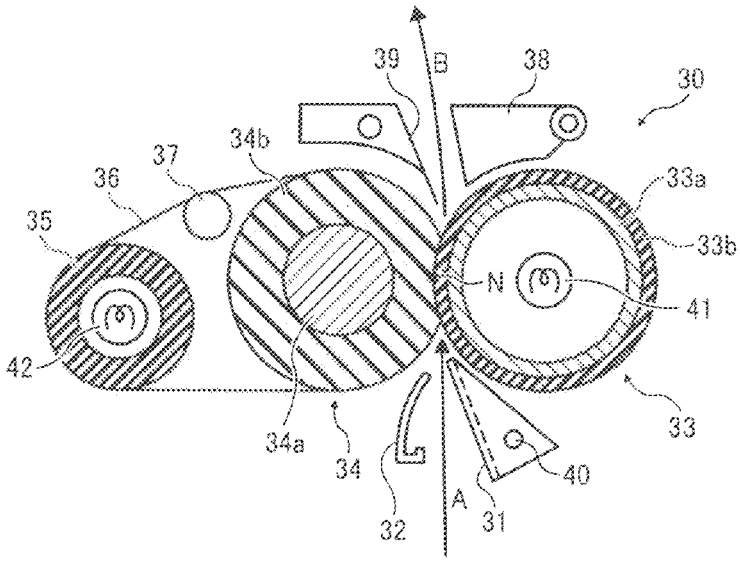
FIG. 2 is a cross-sectional diagram illustrating a configuration of the fixing device shown in FIG. 1.

FIG. 2 is a cross-sectional diagram illustrating a configuration of the fixing device shown in FIG. 1.

As illustrated in FIG. 2, the fixing device 30 includes a pressure roller 33 that serves as a pressure rotary member, a fixing roller 34, a heating roller 35, an endless fixing belt 36 that serves as a fixing rotary member, a tension roller 37.

The pressure roller 33 contacts the fixing roller 34 via the fixing belt 36 so as to attain the fixing nip N of desired width therebetween. The pressure roller 33 includes a cylindrical metal core 33*a*, an elastic layer 33*b* covering the cylindrical metal core 33*a*, and a heater 41. The elastic layer can be formed with silicon rubber, foamed silicon rubber, fluorine-containing rubber, or the like. Further, a thin release layer formed with PFA (tetrafluoroethylene-perfluoro alkyl vinyl ether copolymer), PTFE (polytetrafluoroethylene), or the like can be provided on an outer surface of the elastic layer 33*b*. The heater 41 such as a halogen heater is located inside the pressure roller 33 along the axial direction of the pressure roller 33. The heater 41 heats the pressure roller 33. A start-up time in a cold start can be reduced when the pressure roller 33 receives heat from the outer surface of the fixing belt 36 in addition to a heater 41.

The pressure roller 33 drives the fixing belt 36 in cooperation with the fixing roller 34.

The fixing roller 34 includes a metal core 34*a* such as stainless steel and aluminum, and an elastic layer 34*b*. The elastic layer 34*b* is provided on the core metal 34*a* and the elastic layer 34*b* is formed with heat resistant materials such as fluoro rubber, silicon rubber, and foamed silicon rubber. The thickness of the elastic layer 34*b* is larger than the thickness of the elastic layer 33*b* and the thickness of the elastic layers 33*b* and 34*b* is adjusted suitably. The fixing roller 34 is biased by a spring, not shown, in a direction to press against the pressure roller 33.

The heating roller 35 includes a cylindrical metal core 35*a* and a heater 42 such as halogen heater. The heater 42 heats the metal core 35*a*. It is to be noted that the heater 42 located inside the heating roller 35 has a rated power larger than that of the heater 41 located inside the pressure roller 33.

The fixing belt 36 is looped around the fixing roller 34 and the heating roller 35. The fixing belt 36 rotates counterclockwise and transports the sheet S in a direction shown by arrow B (sheet transport direction). The fixing belt 36 is a flexible thin endless belt. For example, the fixing belt 36 has a thickness of 1 mm or thinner and includes a base layer, an elastic layer, and a release layer from the side of an inner circumferential surface. The respective layers of the fixing belt 36 in the present embodiment are described below. The base layer has a layer thickness of within a range from 30 μm to 100 μm. Examples of a material of the base layer include, but not limited to, metal such as nickel and stainless steel; and resin such as polyimide. The elastic layer has a layer thickness of within a range from 100 μm to 300 μm and can be formed with rubber. Examples of a material of the elastic layer include, but not limited to, silicone rubber, foamed silicone rubber, and fluorine-containing rubber. Providing the elastic layer in the fixing belt 36 can prevent or reduce minute asperities created on an outer surface of the fixing belt 36 in the fixing nip, and thus heat can be uniformly transmitted to a toner image on the sheet S. If heat is unevenly transmitted to the toner image, a fixed image will be a so-called orange-peel image, which means an image whose surface is irregular or grainy like the surface of oranges. Thus, providing the elastic layer in the fixing belt 36 can prevent or reduce orange-peel images. The release layer has a thickness within a range from 10 μm to 50 μm. Examples of a material of the release layer include, but not limited to, PFA, PTFE, polyimide, polyether imide, polyether sulfide (PES). Providing the release layer can give the fixing belt 36 toner releasability.

The tension roller 37 presses the fixing belt 36 outward from to give the fixing belt 36 a predetermined or desired tension.

Temperature sensors are, for example, thermistor and are located to face the fixing belt 36 and the pressure roller 33 to detect temperatures thereof, respectively.

The fixing device 30 further includes a separator 39, an outlet guide board 38.

The separator 39 such as a separating board and a claw is provided downstream of the fixing nip N in the sheet transport direction shown by arrow B, with a gap between a tip thereof and the outer surface of the fixing belt 36. The gap prevents the surface of the fixing belt 36 getting damaged. When the sheet S adheres to the outer surface of the fixing belt 36, the separator 39 separates the sheet S from the fixing belt 36 while the sheet S is transported to prevent the sheet S from being wound around the fixing belt 36. Since the toner has not adhered at the tip of the sheet S, the tip of the sheet S does not stick to the fixing belt 36. For this reason, the separator 39 enters between the tip of the sheet S and the fixing belt 36, and the sheet S separates from the fixing belt 36.

The sheet S having the toner image on the first side thereof is transported to the fixing device 30 in the direction shown by arrow A, and the inlet guide member 31 guides the sheet S to the fixing nip N. At the fixing nip N, the sheet S is sandwiched and pressed between the fixing roller 34 and the pressure roller 33 and further heated by the fixing belt 36 so as to fix the toner image thereon. The sheet S is then further transported in the direction shown by arrow B by the pressure roller 33 that rotates to drive the fixing belt 36.

Figure 3:
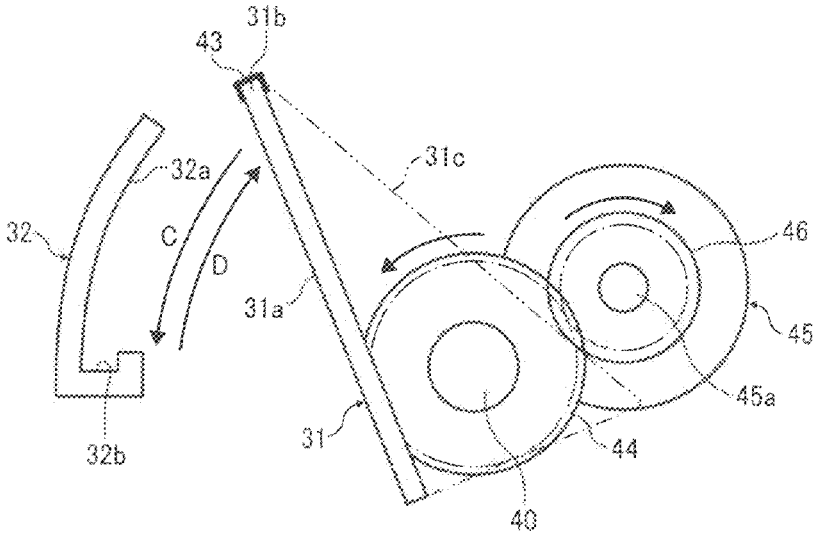
FIG. 3 is an enlarged view illustrating a configuration of a conveyance guide member and a scraper.

FIG. 3 is an enlarged view illustrating a configuration of the inlet guide member and the scraper.

The inlet guide member 31 as the conveyance guide member guides the sheet S to the fixing nip N. The inlet guide member 31 is arranged relative to the fixing nip N at the upstream side of the conveyance direction A (shown in FIG. 2) of the sheet, and is arranged relative to the conveyance path of the sheet at the pressure roller 33 side.

The inlet guide member 31 has a guide surface 31*a*, an end 31*b* of the guide surface 31*a*, and the rotary axis 40. The guide surface 31*a* supports the sheet S going to the fixing nip N. The end 31*b* faces the fixing nip N. The rotary axis 40 is arranged in parallel to an axial direction of the pressure roller 33.

A guide surface 31*a* turns toward the directions shown by arrow C and D centering on the axis 40 parallel to the axial direction of the pressure roller 33 and the fixing roller 34. The guide surface 31*a* pivots at the rotary axis 40 and the inlet guide member 31 is swung back and forth.

The scraper 32 is arranged relative to the inlet guide member 31 at the opposite side on the basis of the conveyance direction A shown in FIG. 2. Therefore, the scraper 32 is arranged at an opposite side of the conveyance direction A of the sheet S with respect to inlet guide member 31. Further, the scraper 32 is arranged relative to the inlet guide member 31 with the conveyance direction A therebetween. The scraper 32 has a scrapable surface 32*a* is formed like the circular arc along the track that the end 31*b* turns and goes the path. The end 31*b* of the inlet guide member 31 contacts the scrapable surface 32*a*, when the inlet guide member 31 turns about the rotary axis 40. Accordingly, the scrapable surface 32*a* corresponds to a path of the inlet guide member 31 when the inlet guide member turns about the rotary axis 40. The scraper 32 is formed by metal or resin.

Next, a foreign substance on the inlet guide member 31 is described below with reference to FIG. 2 and FIG. 3. Since many sheets go into fixing nip N, contacting at the end 31*b* of the inlet guide member 31, in proportion to the number of sheets, a foreign substance adheres on the end 31*b* of the inlet guide member 31. The foreign substance is formed when a toner powder is mixed with paper powder which the sheet has. The foreign substance may grow in a shape like a cone, when the number of sheets of the paper which passes through the fixing nip N increases the foreign substance becomes too large, the foreign substance may separate from the inlet guide member 31 and the foreign substance will fall from the end 31*b* of the inlet guide member 31. Further, an unusual toner image may be caused when the foreign substance falls on the sheet under conveyance. As especially shown in FIG. 1, when fixing device is arranged above the conveyance course (above the secondary transfer nip), the foreign substance may easily fall on the sheet under transportation.

When the inlet guide member 31 carries out both-way movement in the directions shown by arrows C and D, the end 31*b* contacts the scrapable surface 32*a* of the scraper 32 and the inlet guide member 31 scrapes the end 31*b* on the scrapable surface 32*a*. The scraper 32 removes foreign substances on the end 31*b* of the inlet guide member 31. Moreover, the foreign substance which has adhered at the end 31*b* of the inlet guide member 31 is scraped before the foreign substance becomes too large at the end 31*b* of the inlet guide member 31. Thus, the problem that the foreign substance on the end 31*b* causing an abnormal image (unusual toner image) can be solved.

Next, the details of the inlet guide member 31 and the scraper 32 are described below with reference to FIG. 3 and FIG. 4.

The release material 43 is coated on the end 31*b* of the inlet guide member 31 as shown in FIG. 3. The release material 43 includes fluorocarbon resin such as PFA and PTFE. Therefore, it becomes difficult that the foreign substance adheres on the end 31*b* by the coating of a fluoro resin. Even if the foreign substance adheres on the end 31*b* of the inlet guide member 31, when the end 31*b* contacts the scrapable surface 32*a* of the scraper 32, the foreign substance separates easily from the end 31*b*.

Figure 4:
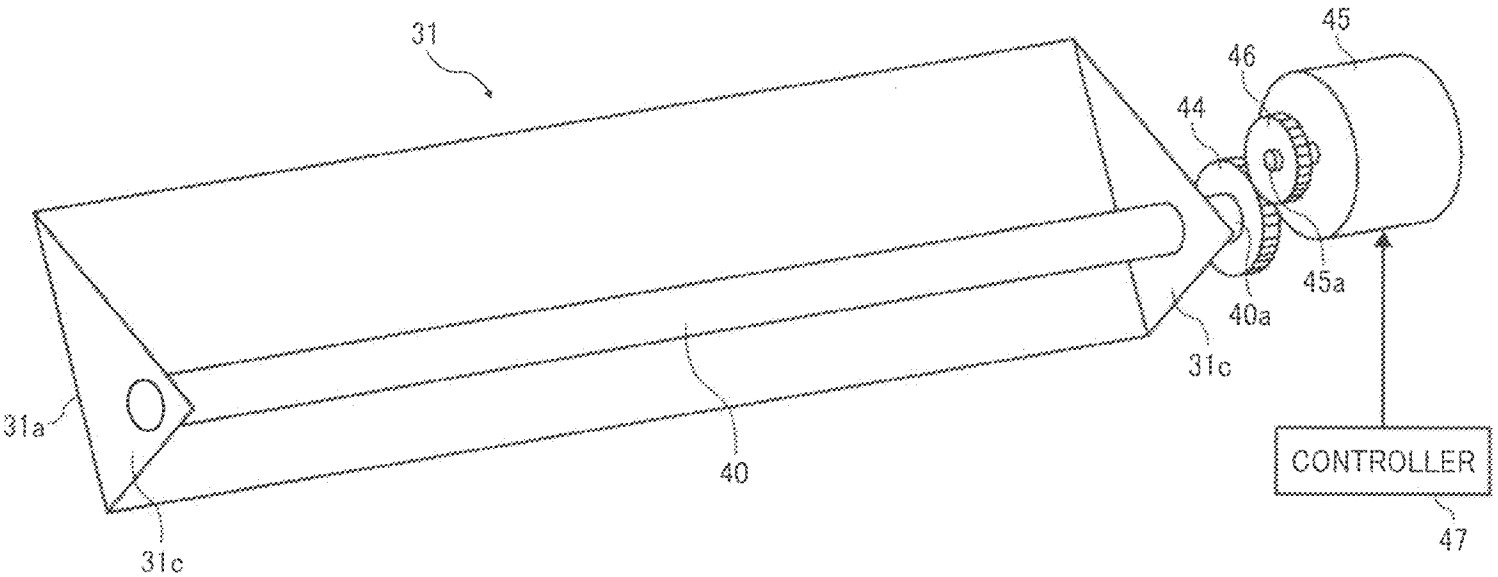
FIG. 4 is a perspective view illustrating the conveyance guide member and a driving mechanism shown in FIG. 2.

FIG. 4 is a perspective view illustrating the inlet guide member and a driving mechanism shown in FIG. 2.

As shown in FIG. 4, the inlet guide member 31 has the guide surface 31*a*, triangular side plates 31*c*, and the rotary axis 40. The guide surface 31*a* is formed with the metal plate with long and slender fixed width. The width of the guide surface 31*a* is formed to the same extent as the width of the sheet S. The pair of side plates 31*c* bend and are formed with the ends of the surface guide 31*a*.

The rotary axis 40 is fixed with the side plates 31*c*. And one end 40*a* of the rotary axis 40 projects outside from one side plate 31*c*. The spur gear 44 is fixed to the end 40*a* of the rotary axis 40. The spur gear 44 meshes with the pinion gear 46 which is fixed to the rotary axis 45*a* of a motor 45.

Therefore, when the motor 45 rotates forward and reverse with a predetermined cycle, the inlet guide member 31 can pivot in the directions C and D (shown in FIG. 3) on the rotary axis 40.

Moreover, if a reduction gear is provided between the axis of the motor 45, and the rotary axis 40, the inlet guide member 31 may turn at the optimum speed.

Moreover, if the motor 45 just turns forward, the inlet guide member 31 could turn forward and reverse by providing a cam mechanism and the link mechanism etc between the motor 45 and the spur gear 44.

Moreover, as shown in FIG. 3, the scraper 32 has a receptacle part 32 like a channel. The receptacle part 32*b* is arranged in parallel to the rotary axis 40. The receptacle part 32*b* is formed a concave shape. The receptacle part 32*b* has a width formed to the same extent as the surface guide 31*a*. The receptacle part 32*b* is provided in the lower end part of the scraper 32 and catches the foreign substance.

When the inlet guide member 31 carries out both-way movement in the direction shown by arrows C and D, and the foreign substance which has adhered at the end 31*b* is scraped, the receptacle part 32*b* catches and can collect the foreign substance. Therefore, it can prevent the foreign substance from dispersing into the image forming apparatus. Further, a serviceman can remove the foreign substance collected on the receptacle part 32*b* easily at the time of a maintenance.

Figure 5:
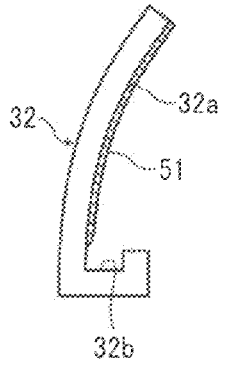
FIG. 5 is an enlarged view illustrating a configuration of a scraper as another embodiment.

FIG. 5 is an enlarged view illustrating a configuration of a scraper as another embodiment.

As shown in FIG. 5, a felt material 51 may be stuck on the scrapable surface 32*a* of the separator 32. The felt material 51 is formed like a thin cloth.

Figure 6:
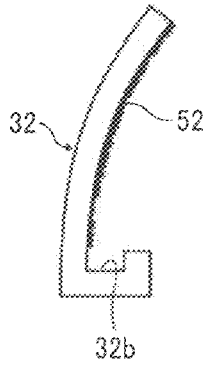
FIG. 6 is an enlarged view illustrating a configuration of a scraper as another embodiment.

FIG. 6 is an enlarged view illustrating a configuration of a scraper as another embodiment.

As shown in FIG. 6, a brush 52 may be stuck on the scrapable surface 32*a* of the separator 32. The brush 52 is formed like a thin mat.

Thus, the effect of the cleaning of the end 31*b* when the inlet guide member 31 reciprocates can be improved further by sticking a component with flexibility such as felts 51 and brushes 52 on the separator 32.

Next, control of the inlet guide member 31 is described below with reference to FIG. 3 and FIG. 4.

As shown in FIG. 4, a controller 47 is connected to the motor 45. The controller 47 includes a drive circuit of the motor 45, such that the controller 47 controls the turn of the inlet guide member 31.

The controller 47 automatically drives the motor 45 at a prescribed time based upon a predetermined condition set up beforehand. The controller 47 turns the inlet guide member 31 so that the end 31*a* of the inlet guide member 31 contacts with the scraper 32. As a result, the inlet guide member 31 is cleaned automatically.

The predetermined condition set up beforehand can mean the case where a power supply of the image forming apparatus 1 installed with the fixing device 30 is switched on, the case where the power supply is switched off, the case where the time set to the timer passes, the case where the print of a fixed number of sheets is performed, etc.

The print number of sheets and the quantity of the foreign substance might be related most. For this reason, the case where conditions print the paper of fixed number of sheets might be most suitable for the predetermined condition. It is because the inlet guide member 31 can be cleaned to the timing suitable for the user's use situation.

Figure 7:
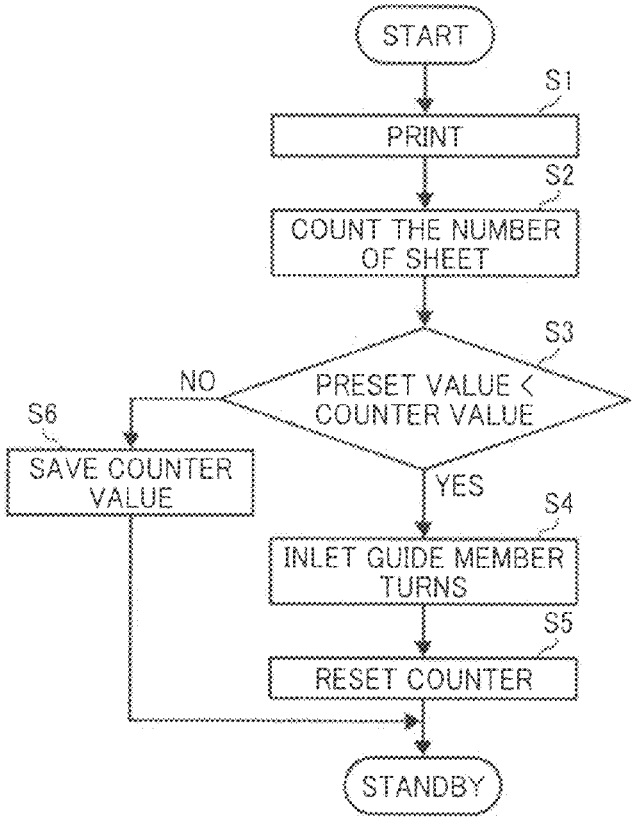
FIG. 7 is a flowchart illustrating steps in an operation of the fixing device according to another embodiment.

FIG. 7 is a flowchart illustrating steps in an operation of the fixing device.

The fixing device prints based on a print job at step S1, when the image forming apparatus receives a print command. A counter counts the number of sheet based on the print job at step S2. The controller 47 compares a preset value (a fixed number of sheets) with a value of the counter at step S3. If the value of the counter becomes larger than the preset value, the inlet guide member 31 turns at step S4. The controller 47 resets the counter at step S5. If the value of the counter still does not reach the preset value at step S3, the controller 47 saves the value of the counter at step S6 and the controller 47 does not turn the inlet guide member 31.

Moreover, a control circuit which controls the whole or a part of the image forming apparatus 1 equipped with the fixing device 30 can also perform turn control of the inlet guide member 31.

(Variations)

A fixing device that scrapes the above-described the inlet guide member is not limited to the configuration described above. The inlet guide member and the scraper described above can be applied to, for instance, fixing devices depicted with references to FIGS. 8 through 13.

(Variation 1)

Figure 8:
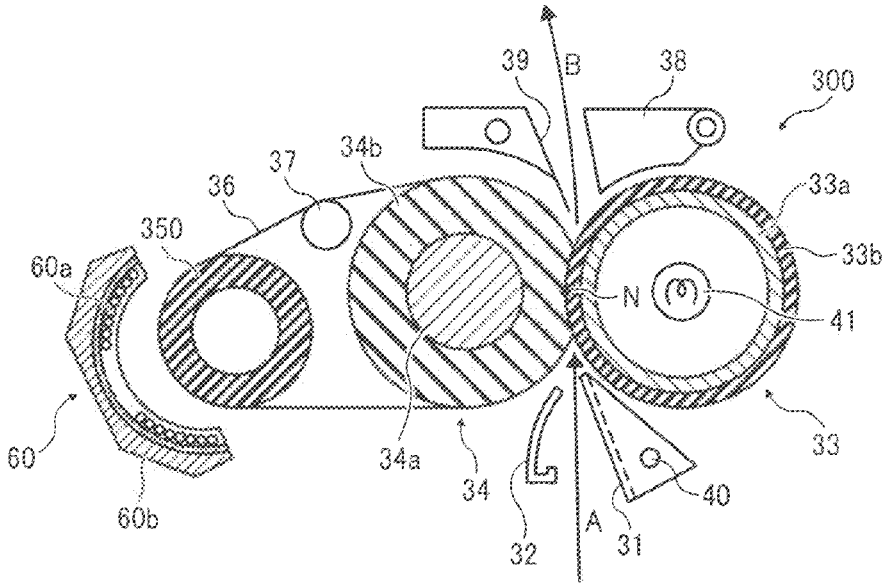
FIG. 8 is a cross-sectional diagram illustrating a configuration of the fixing device shown in FIG. 1 as another embodiment.

As shown in FIG. 8, the fixing device 300 operates almost same as the fixing device 30 shown in FIG. 2. However, heating methods are different.

The heat roller 35 may be heated electromagnetically by an induction heating heater 60 serving as a heater. The induction heating heater 60 disposed in the vicinity of the heat roller 350 includes a coil 60*a* and a core 60*b*. The coil 60*a* generates the magnetic flux. The heat roller 350 is heated inductively by the magnetic flux generated by the coil 60*a*.

(Variation 2)

Figure 9:
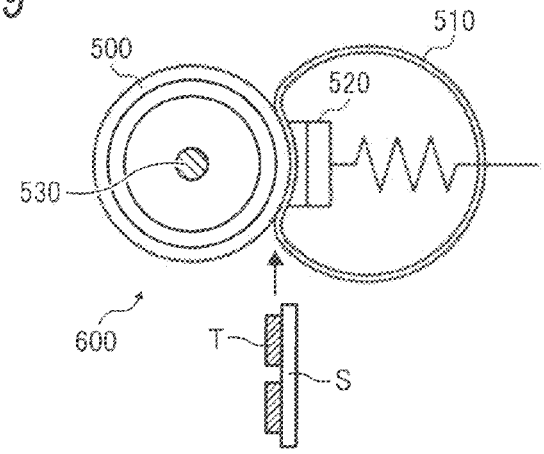
FIG. 9 is a schematic view illustrating a configuration of a fixing device including a fixing roller and a pressure belt.

A fixing device 600 depicted in FIG. 9 includes a fixing roller 500, a pressure belt 510, a pressure pad 520, and a heater 530. The fixing roller 500 serves as a fixing member. The heater 530 serves as a heating member to heat the fixing roller 500. The pressure belt 510 serves as a pressing member and is a seamless belt. The pressure pad 520 causes the pressure belt 510 to press against the fixing roller 500 with a predetermined pressure.

(Variation 3)

Figure 10:
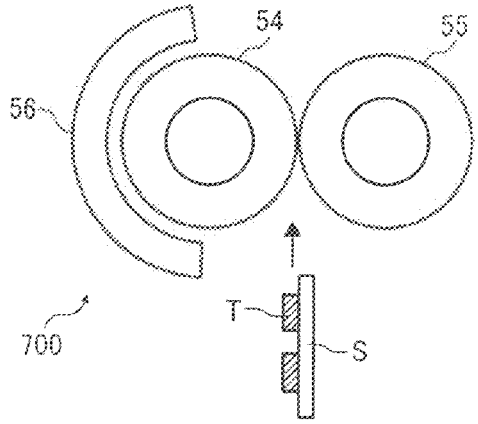
FIG. 10 is a schematic view illustrating a configuration of a fixing device including a fixing roller, a pressure roller, and an induction heating unit serving as a heating member.

A fixing device 700 depicted in FIG. 10 includes a fixing roller 54 serving as a fixing member, an induction heating member (IH coil) 56 serving as a heating member to heat the fixing roller 54, and a pressure roller 55 serving as a pressing member. A fixing nip is formed between the fixing roller 54 and the pressure roller 55.

(Variation 4)

Figure 11:
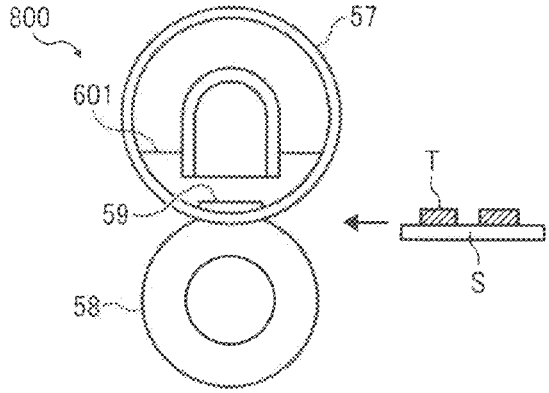
FIG. 11 is a schematic view illustrating a configuration of a fixing device including a flexible fixing sleeve and a pressure roller.

A fixing device 800 depicted in FIG. 11 includes a fixing sleeve 57 serving as a fixing member, a heater 59, a heater holder 601, and a pressure roller 58 serving as a pressing member. The fixing sleeve 57 is a flexible seamless belt. The heater 59 serves as a heating member to heat the fixing sleeve 57. The heater holder 601 holds the heater 59. A fixing nip is formed between the fixing sleeve 57 and the pressure roller 58.

(Variation 5)

Figure 12:
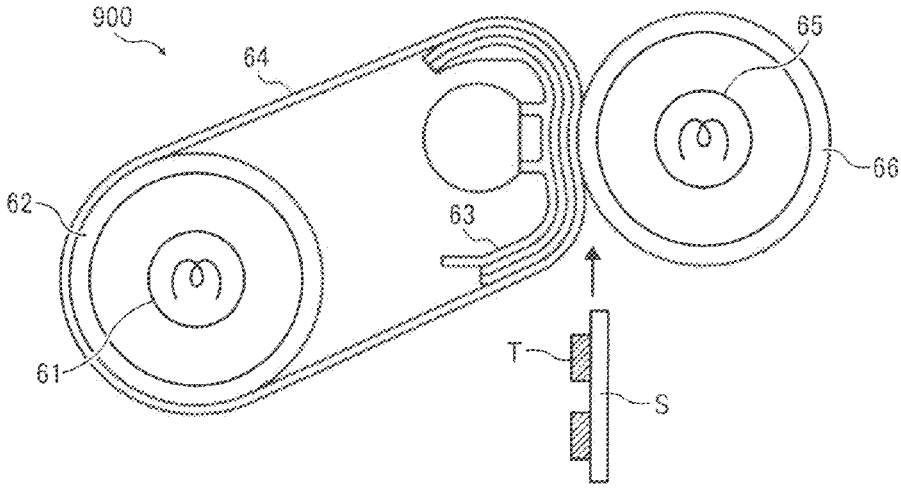
FIG. 12 is a schematic view illustrating a configuration of a fixing device including a fixing belt and a pressure roller.

A fixing device 900 depicted in FIG. 12 includes a heating roller 62 serving as a heating member, a fixing pad 63, a fixing belt 64, and a pressure roller 66 serving as a pressing member. The heating roller 62 includes a heater 61, and the pressure roller 66 includes a heater 65. The fixing belt 64 is wound around the fixing pad 63 and the heating roller 62. The pressure roller 66 that is disposed facing the fixing pad 63 presses against the fixing belt 64 with a predetermined pressure. A fixing nip is formed between the fixing belt 64 and the pressure roller 66.

(Variation 6)

Figure 13:
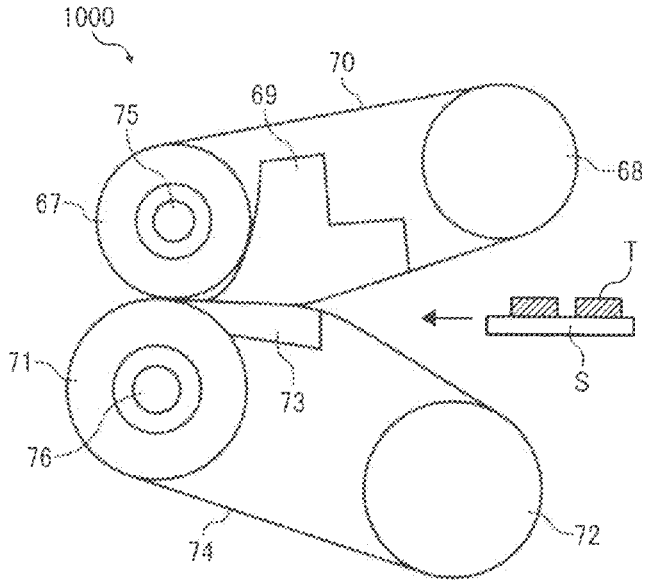
FIG. 13 is a schematic view illustrating a configuration of a fixing device including a fixing belt and a pressure belt.

A fixing device 1000 depicted in FIG. 13 includes a fixing belt 70 serving as a fixing member that is wound around multiple rollers 67 and 68 and a guide member 69, and a pressure belt 74 serving as a pressing member that is wound around multiple rollers 71 and 72 and a guide member 73. The pressure roller 74 is pressed against the fixing belt 70 with a predetermined pressure by the roller 71. The roller 67 includes a heater 75 and the roller 71 includes a heater 76, both serving as heating members. A fixing nip is formed between the fixing belt 70 and the pressure belt 74.

An image forming apparatus is not limited to the configuration described above. The fixing device described above can be applied to, for instance, the image forming apparatus depicted with references to FIG. 14.

The multicolor image forming apparatus 100 is a tandem-type electrophotographic device including an intermediate transfer belt 111.

Figure 14:
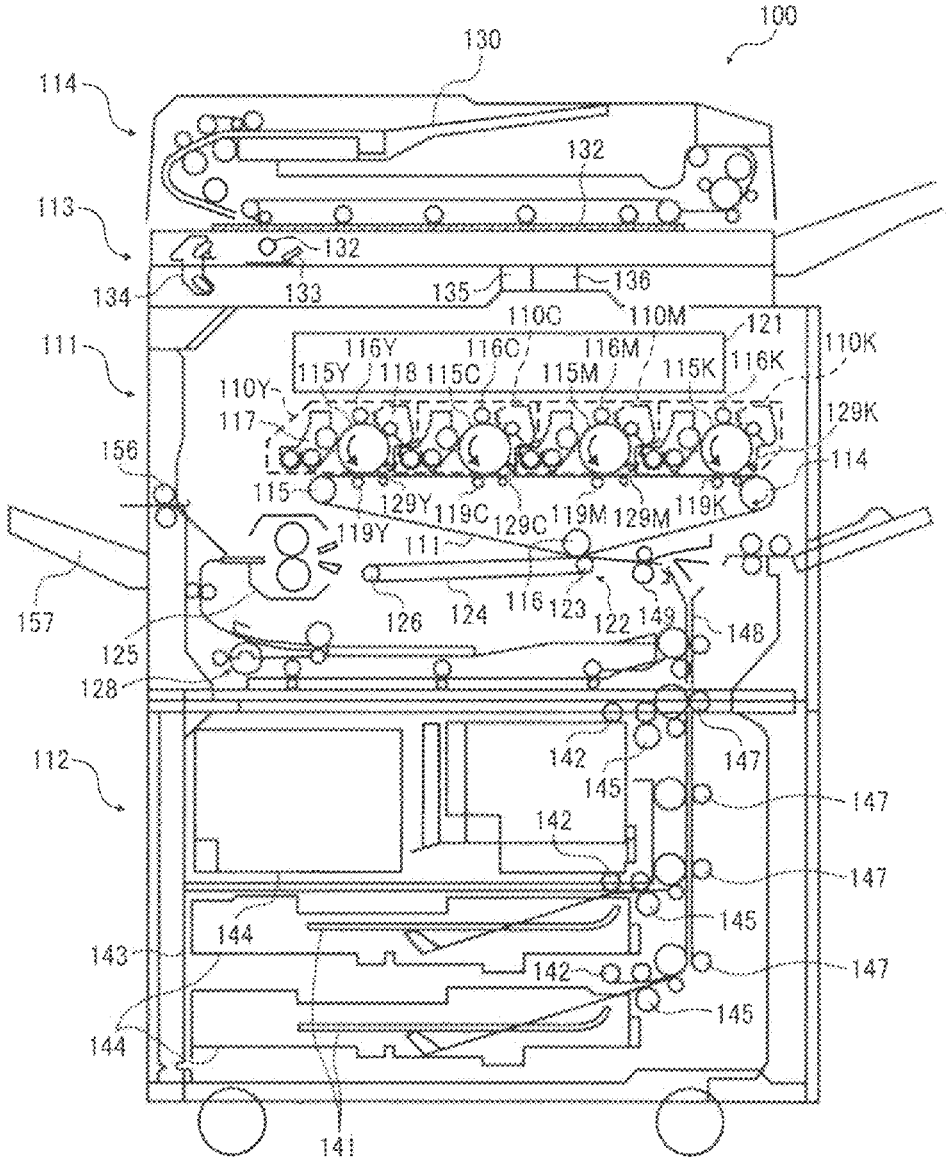
FIG. 14 is an overall schematic view illustrating a configuration of an image forming apparatus including a fixing device according to another illustrative embodiment of the present invention.

In FIG. 14, an automatic document feeder (ADF) 114, a scanner 113, and an image forming body 111 are stacked on a feed unit 112. The image forming apparatus 100 forms images through a latent image forming process, a developing process, a transfer process, a cleaning process, and a fixing process, executed in that order. A configuration of the image forming body 111 is described below.

In a center portion of the image forming body 111, a primary transfer device 119 including the intermediate transfer belt 111 is disposed. The primary transfer device 119 further includes four primary transfer members 119Y, 119M, 119C, and 119K, a driving roller 114, driven rollers 115 and 116, and a belt-cleaning device (not shown).

The intermediate transfer belt 111, which is a seamless (endless) belt, is wound around and is rotated by the driving roller 114 and the driven rollers 115 and 116. The belt-cleaning device (not shown) disposed on the left of the driven roller 115 removes residual toner adhering to the intermediate transfer belt 111 to prepare the intermediate transfer belt 111 for a next image forming process.

Above the primary transfer device 119, four image forming units 110Y, 110M, 110C, and 110K are disposed. It is to be noted that, in the image forming apparatus 100, reference character suffixes Y, M, C, and K attached to identical reference numerals indicate only that components indicated thereby are used for forming different single-color images, respectively, and hereinafter may be omitted when color discrimination is not necessary. Each image forming unit 110 includes a photoreceptor 115, a charging member 116, a developing device 117, a photoreceptor-cleaning blade 118, and an image density detector 129. The photoreceptors 115Y, 115C, 115M and 115K are rotatably disposed along the intermediate transfer belt 111. The developing devices 117, the charging device 116, the photoreceptor cleaner 116, and the image density detector 129 are disposed adjacent to the photoreceptors 115.

The developing device 117 develops an electrostatic latent image formed on the photoreceptor 115 with toner into a single-color toner image in the developing process. Although not depicted in the drawings, a discharging device and a lubrication coating device are disposed in the image forming unit 110 to assist in this process.

Above the image forming units 110, an exposure device 121, which includes a laser light source, is disposed. The exposure device 121 executes an electrostatic latent image forming process to form electrostatic latent images on the respective photoreceptors 115.

Beneath the primary transfer unit 119, a secondary transfer unit 122 that includes a secondary transfer member 123, a roller 126, and a conveyance belt 124 is provided. The secondary transfer member 123 is located beneath the intermediate transfer belt 111 to press against the driven roller 116 via the intermediate transfer belt 111. The secondary transfer unit 122 collectively transfers single-color toner images superimposed one on another on the intermediate transfer belt 111 onto a sheet P, serving as a recording medium, conveyed between the secondary transfer member 123 and the intermediate transfer belt 111. It is to be noted that a transfer roller or a transfer member using a contactless type charger can be used as the secondary transfer member.

Thus, the primary transfer unit 119 and the secondary transfer unit 122 sandwiching the intermediate transfer belt 111 execute transfer processes.

Further, a fixing device 125 is provided downstream from the secondary transfer unit 122 in a direction in which the sheet S is conveyed (hereinafter "sheet conveyance direction"). The sheet S onto which the image is transferred is conveyed to the fixing device 125 by the seamless conveyance belt 124 bridged between the secondary transfer member 123 and the roller 126. The fixing device 125 fixes an image on the sheet with heat and pressure, which is described in further detail later.

Further, a sheet reverse mechanism 128 that reverses the sheet S to form images on both sides of the sheet in duplex printing is provided downstream from the fixing device 125 in the sheet conveyance direction.

Moreover, a pair of discharge rollers 156 and a discharge tray 157 are disposed on a discharge side of the image forming body 111.

Basic operation of the image forming apparatus 100 is described below with reference to FIG. 14.

As sheet feeding modes, the image forming apparatus 100 has a normal mode and a manual feeding mode. When a user makes copies of a document using the image forming apparatus 100, initially, in the normal mode, the user sets a document on a document table 130 of the ADF 114. Alternatively, in the manual feeding mode, the user opens the ADF 114, sets the document on a contact glass 132 of the scanner 113 disposed beneath the ADF 114, and then presses the document with the contact glass 132 by closing the ADF 114.

Subsequently, when a start switch (not shown) is pushed in the normal mode, the document is conveyed automatically to the contact glass 132, and then the scanner 113 is activated. Alternatively, in the manual feeding mode, the scanner 113 is immediately activated after the start switch is pushed. When the scanner 113 is activated, a first carriage 133 and a second carriage 134 begin moving. Therefore, a light source 137 disposed adjacent to the first carriage 133 emits a laser light onto the document, and a pair of mirrors in the second carriage 134 turns a direction in which the ray of light travels 180 degrees. Then, the ray of light passes though an imaging lens 135 and enters a reading sensor 136, and the contents of the document are read by the reading sensor 136.

Along with these processes, when the start switch is pushed, the photoreceptor 115Y, 115M, 115C, and 115K are rotated, timed to coincide with the rotation of the intermediate transfer belt 11, and single-color toner images are formed on the respective photoreceptors 115. Then, the respective single-color toner images are superimposed one on another on the intermediate transfer belt 111 that rotates clockwise in FIG. 14, and thus a superimposed multicolor toner image is formed thereon.

Additionally, along with these processes, a feed roller 142 of a selected rack of the feed unit 112 rotates, and sheets are fed out from a selected feed tray 144 in a feed unit 143 one by one from the top, separated by a separation roller 145. Then, the sheet thus fed is conveyed, guided by a conveyance guide 148, to the image forming body 111 by multiple conveyance rollers 147 and is stopped by a pair of registration rollers 149.

Subsequently, timed to coincide with the arrival of the multicolor-toner image on the intermediate transfer belt 111, the pair of registration rollers 149 starts rotating to convey the sheet between the intermediate transfer belt 111 and the secondary transfer member 123. Then, the multicolor-toner image is transferred onto the sheet by the secondary transfer member 23.

Subsequently, the sheet carrying a multicolor-toner image thereon is conveyed to the fixing device 125 by the conveyance belt 124 in the secondary transfer device 122, and the fixing device 125 executes a fixing process to fix the multicolor-toner image on the sheet with heat and pressure.

Thereafter, the sheet is guided toward the discharge side of the image forming apparatus and is discharged to the discharge tray 157 by the discharge roller 156.

Alternatively, when duplex printing to record images on both sides of the sheet is selected, after the image is formed on one side of the sheet, the transfer-sheet is fed to the sheet reverse mechanism 128. The sheet thus reversed is conveyed to a position facing the secondary transfer member 122 so as to form an image on the other side of the sheet, and then the sheet is discharged to the discharge tray 157 by the discharge roller 156.

Herein, when monochrome images (black image) are formed on the intermediate transfer belt 111, the driven rollers 115 and 116 are moved but the driving roller 114 is not, and the photoreceptors 115Y, 115C, 115M for the yellow, cyan, and magenta are separated from the intermediate transfer belt 111. Additionally, if an image forming apparatus that is not a tandem-type apparatus as shown in FIG. 14 but is a one-drum type and includes only a single photoreceptor drum is used, generally, a black image is initially formed so as to increase the first copy speed, after which other color images are formed when multicolor images are formed.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device to fix a toner image on a sheet of recording media, the fixing device comprising:

a fixing rotary member that heats the toner image on the sheet of the recording media;

a pressure rotary member, pressed against the fixing rotary member, that forms a fixing nip therebetween through which the sheet passes;

a conveyance guide member upstream of the fixing nip in a conveyance direction of the sheet, the conveyance guide member including, a guide surface that supports the sheet prior to the fixing nip, an end of the guide surface, the end facing the fixing nip, and a rotary axis parallel to an axial direction of the pressure rotary member;

a driving mechanism to turn the conveyance guide member about the rotary axis;

a scraper at an opposite side of the conveyance direction of the sheet with respect to the conveyance guide member, wherein the scraper contacts the end of the conveyance guide member, when the conveyance guide member turns about the rotary axis of the guide member.

2. The fixing device according to claim 1, wherein the end of the guide surface is coated with fluorocarbon resin.

3. The fixing device according to claim 1, wherein the scraper includes a receptacle to hold a foreign substance scraped by the scraper.

4. The fixing device according to claim 3, wherein the receptacle is at a lower end part of the scraper.

5. The fixing device according to claim 4, wherein the receptacle has a concave shape to accommodate the foreign substance.

6. The fixing device according to claim 1, wherein the scraper includes a scrapable surface formed in an arc shape that corresponds to a path of the guide surface when the conveyance member turns about the rotary axis.

7. The fixing device according to claim 6, wherein the scraper includes a felt material on the scrapable surface.

8. The fixing device according to claim 6, wherein the scraper includes a brush on the scrapable surface.

9. The fixing device according to claim 1, further comprising:

a controller configured to control the driving mechanism so that the conveyance guide member turns forward and reverse.

10. The fixing device according to claim 9, wherein the controller controls the conveyance guide member at a prescribed time that corresponds to a predetermined condition set up beforehand.

11. The fixing device according to claim 10, wherein the predetermined condition is a case where printing of a fixed number of sheets is performed.

12. The fixing device according to claim 1, wherein the first rotary member is an endless belt and the pressure rotary member is a pressure roller.

13. An image forming apparatus comprising:

an image carrier;

a charging device that charges the image carrier uniformly;

an exposure device that exposes a charged surface of the image carrier and that forms a latent image on the image carrier;

a developing device that visualizes the latent image formed on the surface of the image carrier;

a transfer device that transfers the visualized image onto a sheet of recording medium directly or indirectly via an intermediate transfer member; and a fixing device to fix the image on the sheet, the fixing device including, a fixing rotary member that heats the toner image on the sheet, a pressure rotary member pressed against the fixing rotary member, that forms a fixing nip therebetween through which the sheet passes, a conveyance guide member upstream of the fixing nip in a conveyance direction of the sheet, the conveyance guide member including, a guide surface which supports the sheet prior to the fixing nip, an end of the guide surface, the end facing the fixing nip, and a rotary axis parallel to an axial direction of the pressure rotary member, a driving mechanism to turn the conveyance guide member about the rotary axis, and a scraper at an opposite side of the conveyance direction of the sheet with respect to the conveyance guide member, wherein the scraper contacts the end of the conveyance guide member, when the conveyance guide member turns about the rotary axis of the guide member.

14. A fixing method to fix a toner image on a sheet of recording media, the fixing method comprising:

fixing the toner image on sheet at a fixing nip between a fixing rotary member and a pressure rotary member;

cleaning a conveyance guide member upstream of the fixing nip in a conveyance direction of the sheet, such that the conveyance guide member supports the sheet going to the fixing nip, by scraping the conveyance guide member on a scraper at an opposite side of the conveyance direction of the sheet with respect to the conveyance guide member.

15. The fixing method according to claim 14, further comprising:

collecting a foreign substance scraped from the conveyance guide member in a receptacle of the scraper.

16. The fixing method according to claim 14, wherein the cleaning step includes scraping the conveyance guide member with a felt material on a scrapable surface of the scraper.

17. The fixing method according to claim 14, wherein the cleaning step includes scraping the conveyance guide member with a brush on a scrapable surface of the scraper.

* * * * *